United States Patent [19]

Ariyama

[11] Patent Number: 4,905,047

[45] Date of Patent: Feb. 27, 1990

[54] WET TYPE IMAGE FORMING APPARATUS

[75] Inventor: Kenzo Ariyama, Yokohama, Japan

[73] Assignee: Ricoh Company, Ltd., Tokyo, Japan

[21] Appl. No.: 308,452

[22] Filed: Feb. 10, 1989

[30] Foreign Application Priority Data

Feb. 12, 1988 [JP] Japan ..... 63-30663
Feb. 12, 1988 [JP] Japan ..... 63-30664

[51] Int. Cl.[4] ..... G03G 15/10

[52] U.S. Cl. ..... 355/256; 355/307; 355/296

[58] Field of Search ..... 355/256, 307, 296, 299

[56] References Cited

U.S. PATENT DOCUMENTS

| | | | |
|---|---|---|---|
| 4,380,388 | 4/1983 | Moraw et al. | 355/307 |
| 4,400,079 | 8/1983 | Landa | 355/307 X |
| 4,428,664 | 1/1984 | Sato et al. | 355/307 X |
| 4,449,475 | 5/1984 | Schinke | 355/307 X |
| 4,522,484 | 6/1985 | Landa | 355/256 |
| 4,733,273 | 3/1988 | Lloyd | 355/256 |
| 4,740,816 | 4/1988 | Clements et al. | 355/256 |

*Primary Examiner*—A. C. Prescott
*Attorney, Agent, or Firm*—Oblon, Spivak, McClelland, Maier & Neustadt

[57] ABSTRACT

A wet type image forming apparatus which comprises: at least one rotary photoconductor drum having a surface on which an electrostatic latent image is formed; a development unit for forming a visual image from the latent image by supplying the photoconductor with a liquid developer; a transferring portion under the photoconductor drum where the developed visual image is transferred to a paper; a cleaning unit for removing the liquid developer which remains on the surface of the photoconductor after the visual image is transferred to the paper. The apparatus further comprises a drip prevention plate which is arranged to come in contact with the photoconductor surface to prevent the liquid developer from dripping through the photoconductor surface. The developer is prevented from dripping onto the transferring portion so that the paper is not stained by the dripped liquid developer.

10 Claims, 6 Drawing Sheets

WET TYPE IMAGE FORMING APPARATUS

BACKGROUND OF THE INVENTION

The present invention relates to a wet type image forming apparatus. More particularly, the present invention relates to a wet type color image forming apparatus which comprises a development means to which a plurality of liquid developers of a different color are selectively supplied to form a multicolored image.

A wet type development means for forming a colored image is widely applicable to various image forming apparatuses such as an electrophotographic copying apparatus and a facsimile system etc. In accordance with a generally used conventional wet type color image forming apparatus, the apparatus comprises one photoconductor unit which is provided with one development device and one cleaning device. The color image forming process is carried out in such a way that images of a different color are formed subsequently one after another on the photoconductor unit. More precisely, first, an optical image analyzed to a specified color is projected on the photoconductor unit to expose the same so that an electrostatic latent image corresponding to the specified color is formed on the photoconductor unit. After that the electrostatic latent image is developed so as to form a visual image by a color liquid developer corresponding to the specified color which developer is selectively supplied to the development device. After that the visual image is transferred to a transfer paper wound around a transfer drum. In this transferring process, some liquid developer is untransferred to the paper and remains on the photoconductor drum. Such untransferred developer remaining on the photoconductor drum is removed by the cleaning device. Each of the exposure process, the development process, the transferring process and the cleaning process mentioned above is carried out repeatedly for each of different colors to form a plurality of color images of a different color which images are superposed on each other to form a multicolored image.

Accordingly, the conventional color image forming apparatus requires a relatively long time for forming a colored image in comparison to a monochrome image forming apparatus since the image forming processes for different colors have to be repeated. In order to obviate this problem, there has been proposed an image forming apparatus which comprises a plurality of photoconductor units disposed side by side in series along a conveyor belt corresponding to different colors, respectively, each unit being provided with a wet type development device and a cleaning device wherein a transferring portion is arranged at a lower side of each photoconductor unit so that a plurality of the transferring portions are disposed in series along the conveyor belt having a longitudinal strip shape. In accordance with such a color image forming apparatus, a transfer paper is placed on and carried by the conveyor belt through the transferring portions where the images of a different color are transferred to the paper one after another in series one above the other so that a multicolored image is formed on the paper while passing through the transferring portions in one circulation of the conveyor belt. Therefore, it bocomes possible to reduce the time for forming the color image as short as a half or less as that of the conventional image forming apparatus so that a high speed operation can be achieved. Such a high speed color image forming apparatus is disclosed for example in Japanese Examined Patent Publication No. 55-6225 of the same applicant as that of the present application.

However, the above mentioned high speed color image forming apparatus has a problem that the liquid developer drips and falls from the development device or the cleaning device onto the transfer paper on the conveyor belt since the transferring portions are located at the lower side of the photoconductor unit, which impairs the quaility of the color image. Therefore, conventionally it has been difficult to realize the high speed wet type color image forming apparatus mentioned above.

A technique for preventing the liquid developer from dripping and falling from the development means is partly disclosed in U.S. Pat. No. 4,435,068. However, the technique does not fully satisfy the requirement for avoiding the drip of the liquid developer to upgrade the quality of the color image formed by the high speed type image forming apparatus using the liquid developer.

SUMMARY OF THE INVENTION

It is therefore an object of the present invention to provide a high speed wet type color image forming apparatus in which a conveyor belt for conveying a transfer paper is disposed under a series of photoconductor units and which apparatus makes it possible to reliably prevent the liquid developer from dripping and falling from the development device or the cleaning device without complicating the structure thereof.

The object of the invention can be achieved by a wet type color image forming apparatus in accordance with the present invention comprising:

a plurality of photoconductors disposed on a line in series on each of which photoconductors an electrostatic latent image of a different color is formed;

a plurality of liquid developer tanks from which a liquie developer of a different color is supplied to the corresponding photoconductors, respectively, to form a visual image thereon;

a transferring portion disposed under each of the photoconductors where the visual image is transferred to a transfer paper in such a way that the visual images of a different color formed on the photoconductors are superposed one above the other in sequence to form a multicolored image on the transfer paper;

a conveyor belt which passes through each transferring portion to interconnect the transferring portions disposed under the plurality of the photoconductors, respectively;

a plurality of cleaning units disposed corresponding to the plurality of the photoconductors, respectively, for removing the liquid developer remaining on the photoconductor after the visual image is transferred to the transfer paper; and a sealing plate disposed for each of the cleaning units in such a way that the sealing plate abuts against the photoconductor surface on an upstream side of a cleaning portion with respect to a direction of the movement of the photoconductor surface so as to prevent the liquid developer from dripping.

With the above mentioned first structure, the liquid developer which flows and falls from the cleaning unit is interrupted by the sealing plate which abuts against the photoconductor surface in the upstream side of the cleaning portion with respect to the direction of the movement of the photoconductor surface so that the liquid developer is prevented from dripping.

Also, in accordance with a preferred embodiment of the present invention, the sealing plate is secured to a support member through a spacer in such a way that a gap is formed between the sealing member and the support member so as to form a double seal structure.

With the above mentioned second structure, the liquid developer remaining on the photoconductor drum surface after the transferring operation is allowed to pass through the sealing plate to the cleaning area whereas the liquid developer which flows out of the cleaning area is interrupted by the sealing plate without dripping downward onto the area below the photoconductor drum. Also, the liquid developer which sticks on the rear surface of the sealing plate is prevented from dripping onto the area below the photoconductor drum due to the function of the double seal structure.

Also, in accordance with another preferred embodiment of the present invention, the support member to which the sealing plate is secured is a front edge of a casing of the cleaning unit wherein the sealing plate is arranged in such a way that a fixing side edge of the sealing plate is projected inward into the casing over the front edge thereof and that the sealing plate is inclined so that the fixing side edge thereof becomes a lower edge thereof directed to a reservoir formed in the casing.

With the above mentioned third structure, the liquid developer received by the sealing plate is guided along this sealing plate to a reservoir formed in the bottom of the casing. Also, the liquid developer which sticks on the rear side of the sealing plate is guided along the inclined surface of the sealing plate to the reservoir.

Also, the above mentioned object of the present invention can be achieved by a wet type color image forming apparatus in accordance with the present invention comprising:

a plurality of photoconductors disposed on a line in series on each of which photoconductors an electrostatic latent image of a different color is formed;

a plurality of liquid developer tanks from each of which tanks a liquid developer of a different color is supplied through a development unit to a corresponding photoconductor to form a visual image thereon;

a transferring portion disposed under each of the photoconductors;

a conveyor belt which passes through each transferring portion to interconnect the transferring portions disposed under the plurality of the photoconductors, respectively;

a liquid drip prevention plate disposed for each of the development units in such a way that the liquid drip prevention plate abuts against the photoconductor surface on an upstream side of a development portion with respect to a direction of the movement of the photoconductor surface so as to prevent the liquid developer from dripping.

With the above mentioned fourth structure, the liquid developer which flows out of the development unit is interrupted by the drip prevention plate in the downstream side of the development area with respect to the direction of the movement of the photoconductor so as to prevent the liquid developer from dripping.

Also, in accordance with a preferred embodiment of the present invention, the liquid drip prevention plate is linked with a drive control means which drives the drip prevention plate in such a way that during the time that the developed visual image passes the portion where the drip prevention plate is mounted, this drip prevention plate is moved away from the photoconductor to be discontacted therefrom.

With the above mentioned fifth structure, the drip prevention plate is driven at a predetermined timing by the drive means to be moved away from the photoconductor so as not to scrape the developed visual image by the drip prevention plate.

Further, in accordance with another preferred embodiment of the present invention, the liquid drip prevention plate means comprises a first drip prevention plate which covers an entire width of an effective image forming area on the photoconductor surface and a second drip prevention plate which is disposed in a downstream side of the first drip prevention plate with respect to the direction of the movement of the photoconductor and which extends from an end portion of the first drip prevention plate to an end portion of the photoconductor.

With the above mentioned sixth structure, the developer is almost completely prevented from dripping by the two step arrangement of the drip prevention plate wherein the developer which overflows out of the effective image forming area on the photoconductor surface is interrupted and prevented from dripping therefrom by the first drip prevention plate which abuts against the photoconductor surface and wherein the developer which overflows out of the end of the first drip prevention plate is interrupted and prevented from dripping by the second drip prevention plate which also abuts against the photoconductor surface.

Advantages of the above mentioned first structure are that the liquid developer is reliably prevented from dripping from the cleaning unit without complicating the structure thereof and that it becomes possible to avoid to stain the transferring portion by the liquid developer dripping from the cleaning unit, thus realizing a high speed wet type color image forming apparatus in which the conveyor belt for conveying the transfer paper is disposed under the photoconductor.

Advantages of the above mentioned second structure are that the liquid developer flowing down from the cleaning area is received by the sealing plate and prevented from dripping onto the portion under the photoconductor and that the liquid developer which sticks on the rear side of the sealing plate is reliably prevented from dripping due to the double seal structure.

Advantages of the above mentioned third structure are that the liquid developer received by the sealing plate is guided along the inclined plate surface to the reservoir formed in the bottom of the casing as well as the liquid developer sticking to the rear side of the sealing plate so that the liquid developer is effectively collected in the reservoir and discharged therefrom for reuse the same.

Also, advantages of the above mentioned fourth structure are that the liquid developer is reliably prevented from dripping from the cleaning unit without complicating the structure thereof and that it becomes possible to avoid staining the transferring portion by the liquid developer dripping from the cleaning unit, thus realizing a high speed wet type color image forming apparatus in which the conveyor belt for conveying the transfer paper is disposed under the photoconductor.

An advantage of the above mentioned fifth structure is that the liquid drip prevention plate reliably functions without scraping the visual image formed on the photoconductor surface in the development process.

Also, an advantage of the above mentioned sixth structure is that the developer is almost completely prevented from dripping by the two step arrangement of the drip prevention plate wherein the developer which overflows out of the effective image forming area on the photoconductor surface is interrupted and prevented from dripping therefrom by the first drip prevention plate which abuts against the photoconductor surface and wherein the developer which overflows out of the end of the first drip prevention plate is interrupted and prevented from dripping by the second drip prevention plate which also abuts against the photoconductor surface, thus reliably preventing the transferring portion from being stained.

Further objects and advantages of the present invention will be apparent from the following description of the preferred embodiments of the invention as illustrated in the accompanying drawings.

DESCRIPTION OF THE PREFERRED EMBODIMENTS

Preferred embodiments of the present invention are described hereinafter in detail with reference to the accompanying drawings.

Figure 1:
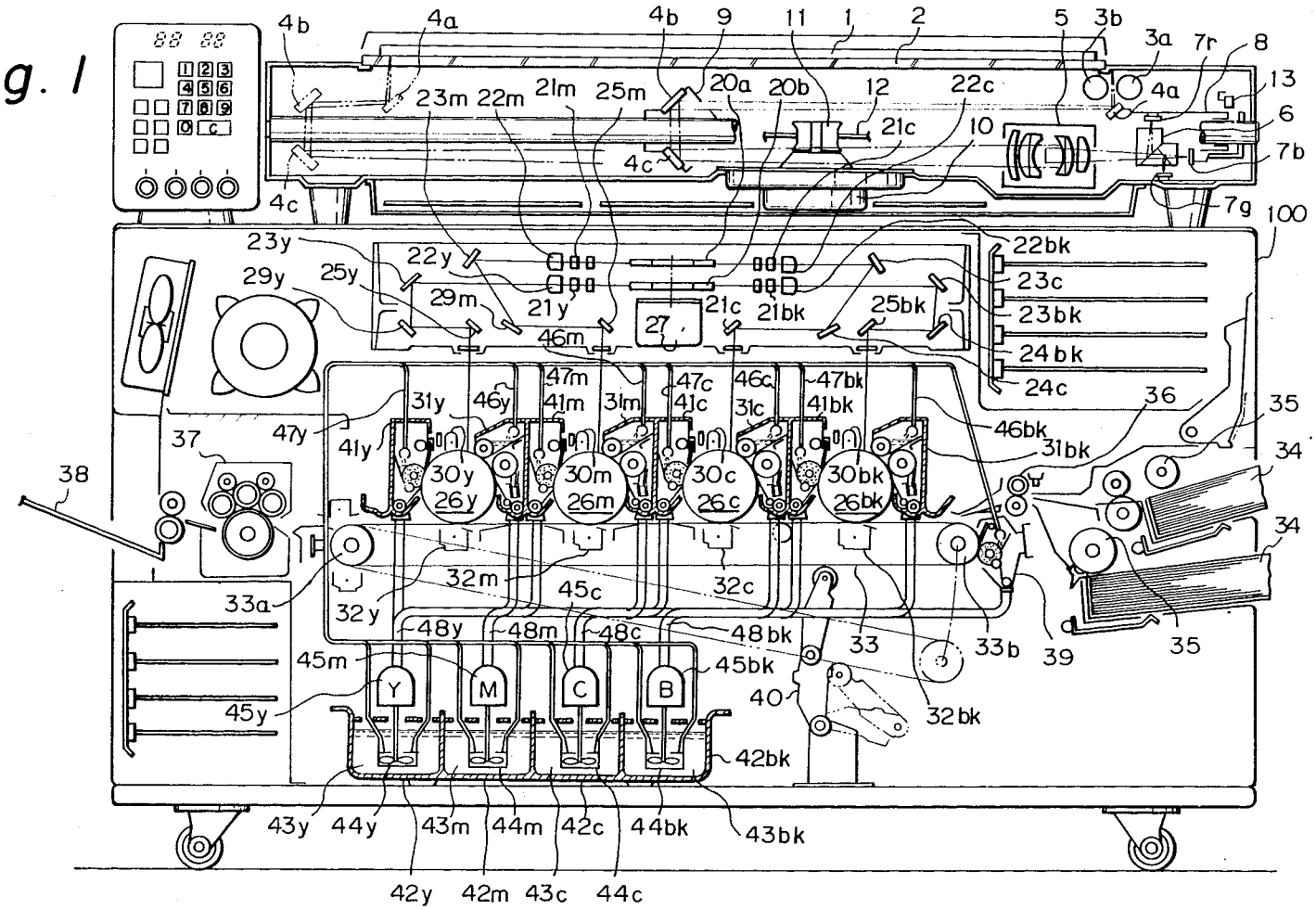
FIG. 1 is a constructional view showing a whole structure of a wet type electrophotographic color copying apparatus in accordance with the present invention.

FIG. 1 illustrates a whole structure of a wet developement type multicolor copying apparatus as an example of the wet type color image forming apparatus in accordance with the present invention. An original 1 to be copied is placed on a platen (contact glass) 2 and irradiated to be exposed by a light emitted from each of fluorescent lamps 3*a* and 3*b*. The light is reflected by the original and this reflection light from the original is further reflected by a first mirror 4*a*, a second mirror 4*b* and a third mirror 4*c*, respectively, which mirrors 4*a*, 4*b* and 4*c* are movable. The reflection light then passes through an imaging lens assembly 5 and enters a dichroic prism 6 which analyzes the reflection light to three spectra i.e., a red spectrum, a green spectrum and a blue spectrum. Each of the analyzed three spectra is introduced into a corresponding image sensor element comprising a CCD (charge coupled device) 7*r*, 7*g* and 7*b*. That is, the red spectrum light is received by the CCD 7*r*, the green spectrum light is received by the CCD 7*g* and the blue spectrum light is received by the CCD 7*b*, respectively.

The fluorescent lamps 3*a* and 3*b* and the first mirror 4*a* are carried on a first carriage 8. The second mirror 4*b* and the third mirror 4*c* are carried on a second carriage 9. The second carriage 9 moves at a speed a half of the speed of the first carriage 8 so that the length of the optical path from the original to the CCDs is maintained constant during a scanning motion of the first carriage 8 and the second carriage 9 from the right side position to the left side position in the drawing when reading the image of the original. A carriage drive pulley 11 is secured to a rotary shaft of a carriage drive motor 10. A carriage drive wire 12 is wound around the pulley 11. The above mentioned first carriage 8 is connected to this carriage drive wire 12. Also, the wire 12 is wound around a pulley (not shown) mounted on the second carriage 9. With this arrangement, the first carriage 8 and the second carriage 9 are driven to move forward by a normal rotation of the motor 10 for a scanning operation to read an image of the original while move backward by a reverse rotation of the motor 10 for a returning movement thereof to an initial position. Also, with this arrangement, it becomes possible to drive the second carriage 9 at a speed a half of that of the first carriage 8.

FIG. 1 illustrates a state in which the first carriage 8 is positioned at a home position where the first carriage 8 is detected by a reflection type photosensor 13. When the first carriage 8 is driven to move rightward out of the home position for the scanning operation to expose the original, the photosensor 13 does not receive the reflection light from the first carriage 8 so that the photosensor 13 discriminates that the first carriage 8 is not positioned at the home position. On the other hand, when the first carriage 8 is moved back to the home position by the returning operation, the photosensor 13 receives the reflection light from the first carriage 8 so that the photosensor 13 detects the first carriage 8 positioned at the home position. The first carriage 8 is stopped at the moment when the output of the photosensor 13 is changed from the state of not receiving the reflection light to the state of receiving the reflection light.

The outputs of the CCDs 7*r*, 7*g* and 7*b* are converted from analogue data to digital data to be processed by an image processor unit 100 which outputs binary signals representing detected color informations of black (Bk), cyanogen (C), magenta (M) and yellow (Y), respectively. Each of the binary signals is used to energize a semiconductor laser emitting element through a laser driver to emit a laser beam of a corresponding color modulated by the binary signal for recording the color information. The emitted laser beam is reflected by one of rotary polygon mirrors 20*a* and 20*b* and after that passes through a corresponding one of four $f-\theta$ lenses 21*bk*, 21*c*, 21*m* and 21*y* and one of cylindrical lenses 22*bk*, 22*c*, 22*m* and 22*y* for compensation for inclination of the polygon mirror surface. After that the laser beam is further reflected by a corresponding one of fourth mirrors 23*bk*, 23*c*, 23*m* and 23*y*, one of fifth mirrors 24*bk*, 24*c*, 24*m* and 24*y* and one of sixth mirrors 25*bk*, 25*c*, 25*m* and 25*y*, in this order. After that the laser beam irradiates a corresponding one of four photoconductor drums 26*bk*, 26*c*, 26*m* and 26*y*.

The rotary polygon mirrors 20*a* and 20*b* are secured to a rotary shaft of a polygon mirror drive motor 27 which is driven to rotate at a constant speed so that the polygon mirrors are rotated at a constant speed. By rotating the polygon mirror, the reflected laser beam is moved to scan the photoconductor drum surface along the longitudinal drum axis thereof which is perpendicular to the direction of the rotation of the drum (clockwise direction in this particular embodiment).

The above mentioned four photoconductor drums 26*bk*, 26*c*, 26*m* and 26*y* are disposed side by side at regular intervals in a row in such a way that the drum axes thereof are in parallel with each other. The surface of each photoconductor drum is electrostatically charged evenly by a corresponding one of electrostatic chargers 30*bk*, 30*c*, 30*m* and 30*y* which are connected to a high voltage negative power source (not shown). When the evenly charged photoconductor drum surface is irradiated by the laser beam modulated by the color recording signal, the electric charge of the portion irradiated to be exposed by the laser on the photoconductor surface is grounded to the earth through an apparatus body and extinguishes from the drum surface due to the photoconductive function of the drum. The laser exposure is controlled in such a way that the laser is turned off corresponding to a dark portion of the original so that the potential voltage level of the photoconductor drum surface at the part corresponding to the dark portion of the original is maintained −800V, whereas the voltage of the photoconductor drum surface at the part corresponding to a thin portion of the original becomes about −100V, thereby forming an electrostatic latent image in response to the dark and thin portions of the original. Note that the polarity of the electrostatic charge on the surface of the photoconductor drum 26*bk*, 26*c*, 26*m* and 26*y* depend on the material of the photoconductor.

The electrostatic latent image is developed by a corresponding development unit i.e., one of a black development unit 31*bk*, a cyanogen development unit 31*c*, a magenta development unit 31*m* and a yellow development unit 31*y*, each development unit being attached to a corresponding photoconductor drum so that visual images of black, cyanogen, magenta and yellow are formed on the corresponding photoconductor drums 26*bk*, 26*c*, 26*m* and 26*y*, respectively. Construction and function of the development unit is described in detail later.

The photoconductor drums 26*bk*, 26*c*, 26*m* and 26*y* are provided with a transferring electrostatic charging device i. e., one of transfer chargers 32*bk*, 32*c*, 32*m* and 32*y*, each of which chargers is disposed under the corresponding photoconductor drum and defines a transferring potion of the apparatus. Also, a conveyor belt 33 is disposed along the transferring portions of the photoconductor drums in such a way that the conveyor belt 33 passes between the photoconductor drum and the transfer charger and in contact with the photoconductor drum surface at each transferring portion. The conveyor belt 33 is an endless belt wound around and spanning between a drive roller 33*a* and an idle roller 33*b*. The drive roller 33*a* rotates and drives the conveyor belt 33 in the counter clockwise direction. A cassette 34 in which transfer papers are stacked is disposed in front of (on the right side, in the drawing, of) the conveyor belt 33. The transfer papers are taken out of the cassette 34 one by one at a predetermined timing by a feed roller 35 and transferred onto the conveyor belt 33 through a pair of resist rollers 36 for preventing a double feeding of the papers at a time. The transfer paper is conveyed through the transferring portions of the photoconductor drums 26*bk*, 26*c*, 26*m* and 26*y* in sequence by the conveyor belt 33. During the time that the transfer paper is passing through the transferring portions, the visual images of black, cyanogen, magenta and yellow formed on the photoconductor drum surface are transferred to the transfer paper in sequence due to the function of the transferring electrostatic chargers 32*bk*, 32*c*, 32*m* and 32*y*. After the color images are transferred to the paper, the paper is conveyed to a thermal fixing unit 37 disposed on the left side of and facing the left end of the conveyor belt 33 in the drawing. During the time that the transfer paper is passing through the thermal fixing unit 37, the liquid solution of the developer is vaporized and the toner is fixed to the transfer paper. After that the transfer paper is discharged onto a paper tray 38. On the right side of the conveyor belt 33 at the right end thereof in the drawing, a cleaning device 39 is disposed facing to the idle roller 33*b*. Also, the conveyor belt 33 is constructed in such a way that the velt is swingable about the axis of the drive roller 33*a* so that the belt is movable between a contact position wherein the image transferring operation is carried out (depicted in a solid line) and a separated position wherein the belt is shifted away from the photoconductor drum surface (depicted in a dash-two-dot line). The conveyor belt 33 is driven to rotate about the roller 33*a* by a rotary belt shifting mechanism 40 disposed under the conveyor belt 33.

Also, the liquid developer remaining on the photoconductor drum surface after the transferring operation is removed by the cleaning units 41*bk*, 41*c*, 41*m* and 41*y* attached to the corresponding photoconductor drums 26*bk*, 26*c*, 26*m* and 26*y*, respectively. The structure and function of the cleaning unit is described in detail later.

Liquid developer tanks 42*bk*, 42*c*, 42*m* and 42*y* for each developer of a different color are disposed under the conveyor belt 33. Each of the tanks contains a liquid developer 43*bk*, 43*c*, 43*m* or 43*y*, respectively, in which a suction pump 44*bk*, 44*c*, 44*m* or 44*y* is dipped. The suction pumps 44*bk*, 44*c*, 44*m* and 44*y* are driven by drive motors 45*bk*, 45*c*, 45*m* and 45*y*, respectively, so that the liquid developers 43*bk*, 43*c*, 43*m* and 43*y* are fed to the black development unit 31*bk*, the cyanogen development unit 31*c*, the magenta development unit 31*m* and the yellow development unit 31*y*, respectively, through a developer supply pipe 46*bk*, 46*c*, 46*m* or 46*y*. The liquid developers are also fed to the cleaning units 41*bk*, 41*c*, 41*m* and 41*y*, respectively, through a developer supply pipe 47*bk*, 47*c*, 47*m* or 47*y*. The used developer is returned to the tanks from the development units for reuse the same through return pipes 48*bk*, 48*c*, 48*m* and 48*y*, respectively. Also, the developer used in the cleaning units 41*bk*, 41*c*, 41*m* and 41*y* is returned to the tanks for reuse the same through the return pipes 48*bk*, 48*c*, 48*m* and 48*y*, respectively.

Figure 2:
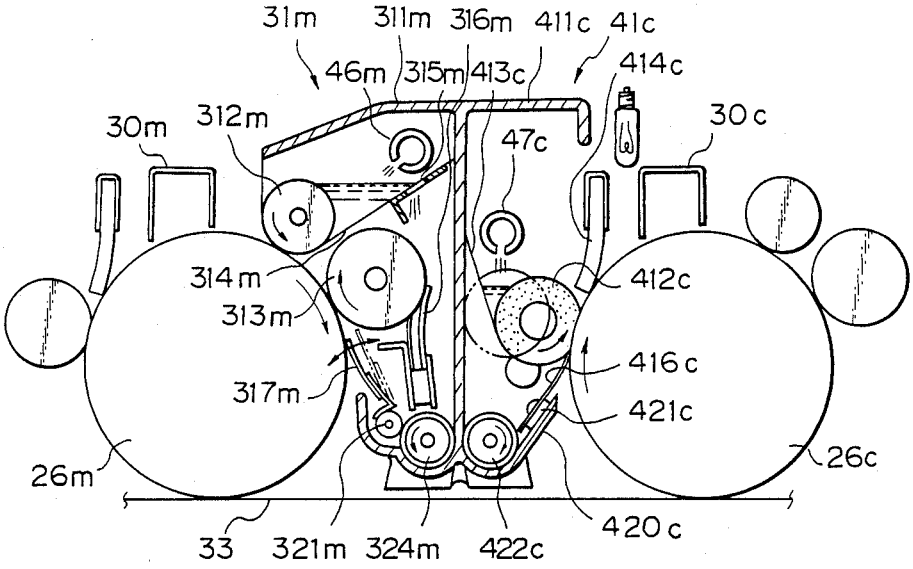
FIG. 2 is a partial sectional view showing a structure of a development device provided with a cleaning device in accordance with an embodiment of the present invention.

A detailed structure of the development unit is illustrated in FIG. 2 which represents a sectional view of the magenta development unit 31*m* as an example. The development unit 31*m* is disposed in the right side of the photoconductor drum 26*m* in the drawing. The development unit 31*m* comprises a casing 311*m* which is formed as an integral structure with a casing 411*c* of the cleaning unit 41*c* for the adjacent photoconductor drum 26*c*. The liquid developer supply pipe 46*m* is connected to an upper portion of the casing 311*m* and opens at the portion. A development roller 312*m* and a squeeze roller 313*m* are disposed in this order along the surface of the photoconductor drum 26m in the ratational direction thereof. The development roller 312m is disposed to face to the surface of the photoconductor drum with a small gap of about 150 μm formed therebetween so as to define a development portion for carrying out a development operation. The development roller 312m is driven to rotate in such a way that the development roller surface moves in the same direction as that of the movement of the photoconductor drum surface in the development portion thereof. A liquid developer receiving tray 314m is disposed in the rear side (right side in the drawing) of the development roller 312m in such a way that an end of the tray pressingly abuts against the development roller 312m. The tray 314m inclines upward in the direction away from the development roller 312m. The opening of the liquid developer supply pipe 46m is positioned above the developer receiving tray 314m. The magenta developer discharged from the supply pipe 46m is accumulated in the liquid developer receiving tray 314m up to a level of about the top of the development roller 312m so that about a whole of the right half of the development roller 312m is dipped in the developer in the tray. An over flow hole 315m is arranged in the upper portion of the tray 314m to discharge an overly supplied developer and maintain a predetermined constant liquid level in the tray. The liquid developer of magenta in the tray comes in contact with the development roller 312m and conveyed to the development portion due to the rotation of the roller where the developer is supplied to the electrostatic latent image formed on the photoconductor drum surface to develop the latent image into a visual image. The squeeze roller 313m is arranged to face to the photoconductor drum surface with a predetermined gap formed therebetween and driven to rotate in such a way that the squeeze roller surface moves in the direction opposite to that of the movement of the photoconductor drum surface in the portion where the two rollers face to each other. With this arrangement, the liquid developer overly supplied to the photoconductor drum surface is prevented from being conveyed downward to the transferring portion. The squeeze roller 313m is provided with a scraper blade 316m disposed on the rear side thereof and abutting against the surface thereof to remove the developer sticking on the roller surface.

Figure 3:
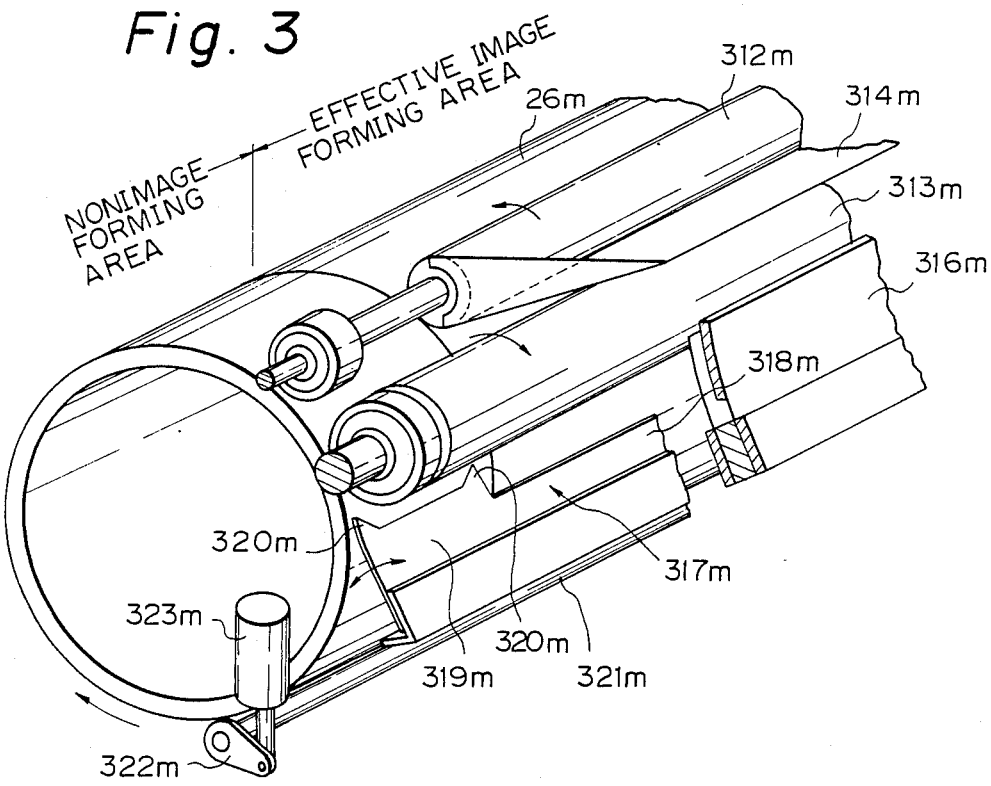
FIG. 3 is a perspective outer view of the development device of FIG. 2.

As can be seen from FIG. 3, a plate 317m for preventing the liquid developer from dripping is disposed in the downstream side of the squeeze roller 313m with respect to the rotational direction of the photoconductor drum, that is in the lower side of the development portion in such a manner that the plate is urged against the surface of the photoconductor drum. This liquid drip prevention plate 317m is made from a flexible plate member formed to have substantially the same width as the photoconductor drum 26m. The liquid drip prevention plate 317m comprises a main portion 318m which faces to and abuts against an effective image forming area of the photoconductor drum 26m and auxiliary portions 319m formed at the both ends of the main portion 318m which auxiliary portions face to and abut against nonimage forming areas on the both outsides of the effective image forming area (only one of the auxiliary portions 319m is illustrated in FIG. 3). The auxiliary portion 319m is formed higher than the main portion 318m so that the abutting pressure of the auxiliary portion against the photoconductor drum is stronger than that of the main portion. Also, the auxiliary portion 319m comprises two ear pieces 320m at the both side edges thereof. Each of the ear pieces 320m has an inclined side inclining toward inner side of the auxiliary portion so that the liquid developer is collected toward the center thereof by the ear pieces. A lower edge of the liquid drip prevention plate 317m is secured to a support shaft 321m to which a swing arm 322m is attached at an end thereof. The swing arm 322m is connected to a drive shaft of a drive plunger 323m. By applying a current to the drive plunger 323m, the liquid drip prevention plate 317m is driven to shift away from the photoconductor drum 26m. On the other hand, by cutting the current off, the liquid drip prevention plate is moved back toward the photoconductor drum and abuts against the surface thereof.

When the liquid drip prevention plate 317m is in the state of abutting against the photoconductor drum surface, the liquid developer which flows down along the photoconductor drum surface from the development portion is interrupted by the plate 317m and prevented from dripping onto the conveyor belt or the transferring portion during the time that the development unit is not being used. Especially, in the nonimage forming areas around the both ends of the photoconductor drum 26m, the auxiliary portion 319m of the drip prevention plate 317m abuts more strongly against the photoconductor drum surface so that the liquid developer is reliably prevented from dripping. Besides, due to the function of the ear pieces 320m of the auxiliary plate 319m, the liquid developer is collected toward the center portion of the auxiliary plate, which increases the functional reliability of the drip prevention plate in the both end portions of the photoconductor drum.

Figure 4:
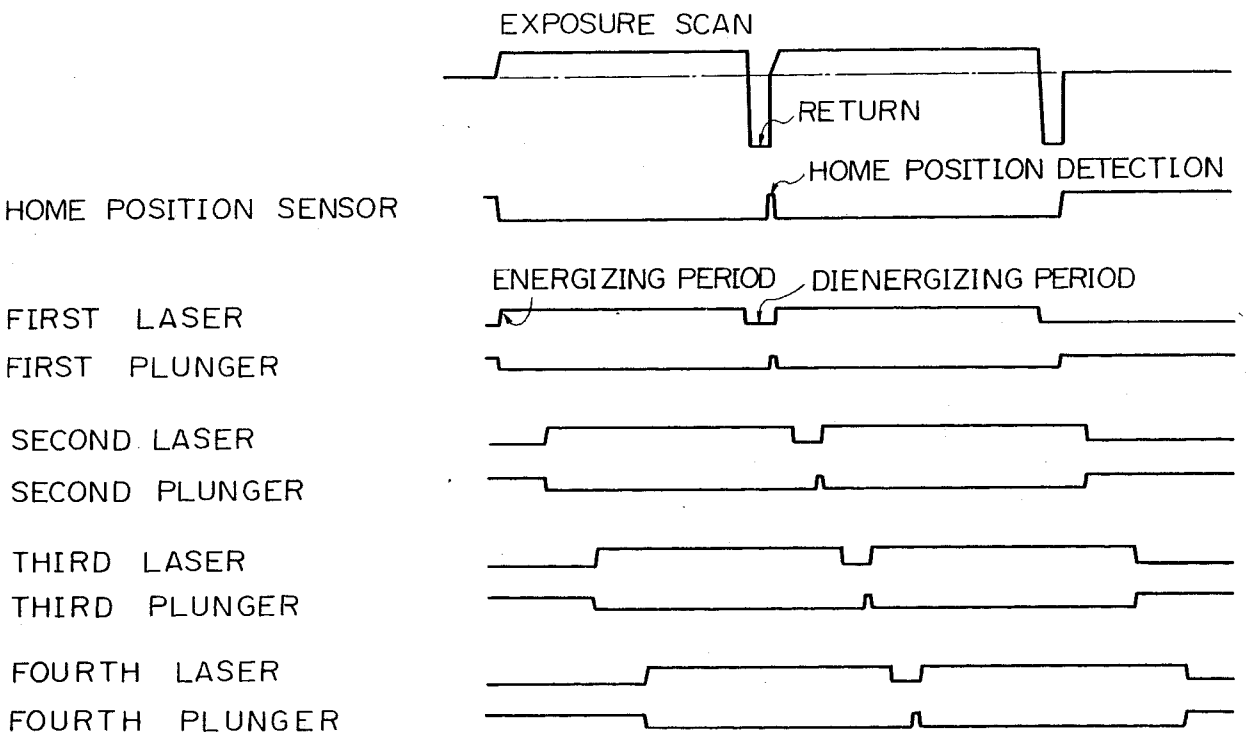
FIG. 4 is a timing chart showing an example of functional timing of a liquid developer drip prevention plate attached to the development device in accordance with the present invention.

The drive plunger 323m interconnected to the liquid drip prevention plate 317m is controlled in such a way that when the scanning exposure system mentioned above is returned to the home position, the electric current is supplied to the drive plunger 323m so that the drip prevention plate 317m is separated away from the photoconductor drum surface. This is explained further in detail with reference to FIG. 4 below. First, in a detection period for discriminating whether the scanning exposure system is in the home position or not, if the exposure system is returned to the home position, the home position sensor detects the existence of the exposure system in the home position. On the basis of the detection signal from the home position sensor, the drive plunger 323m interconnected to the drip prevention plate 317m is supplied with an electric current to move the drip prevention plate away from the photoconductor drum surface to open a gap therebetween. This is for the purpose to prevent the developed visual image formed on the photoconductor drum surface from being scraped by the drip prevention plate 317m while passing the portion of the drip prevention plate. Note that the timing for applying the electric current to the drive plunger is different with respect to each development unit of a different color. That is, the timing for energizing the laser source is delayed according as the development unit is positioned in the downstream side along the direction of the conveyor belt. Accordingly, the timing for dienergizing the laser source is also delayed, which results in that the timing for energizing the plunger is delayed according to the location of the development unit along the conveyor belt.

The lower portion of the development unit casing 311m is formed as a reservoir for collecting and accumulating the liquid developer within the casing. A longitudinal discharge screw 324m for conveying the developer is disposed in the reservoir along the lower edge of the casing in parallel with the rotary axis of the photoconductor drum. The return pipe 48m mentioned above is connected to an outlet of the screw conveyor 324m. The liquid developer in the reservoir is conveyed by the screw conveyor 324m and discharged into the return pipe 48m.

The other development units 31bk, 31c and 31y are constructed in the same manner as the magenta development unit 31m mentioned above, thus description of the structure thereof being deleted.

Figure 5:
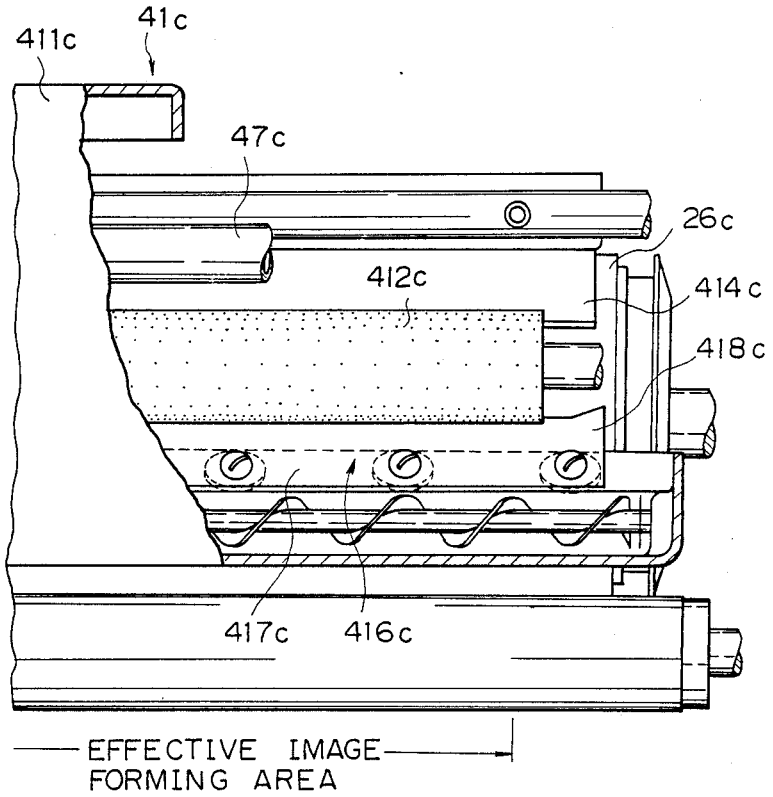
FIG. 5 is a partial sectional view showing a back side of the cleaning device of FIG. 2.
Figure 6:
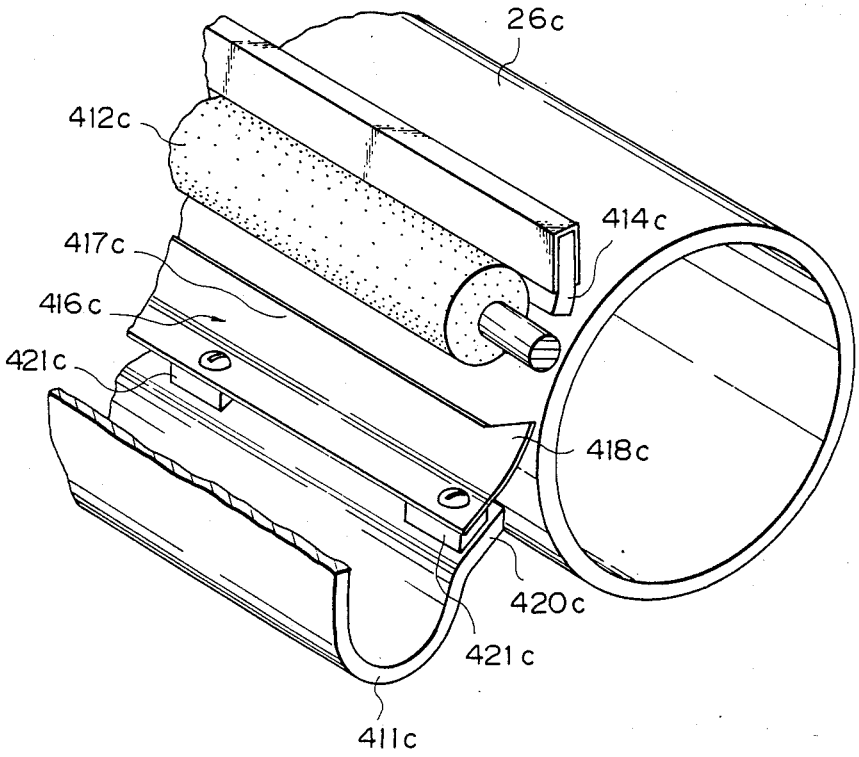
FIG. 6 is a perspective outer view of the cleaning device of FIG. 2 seen from the back side thereof.

The cyanogen cleaning unit 41c disposed adjacent to the magenta development unit 31m is described hereinafter with reference to FIGS. 2, 5 and 6. As can be seen from FIG. 2, and as mentioned before, the casing 411c of the cleaning unit 41c is formed integrally with the casing 311m of the magenta development unit 31m. The liquid developer supply pipe 47c is connected to the upper portion of the cleaning unit casing 411c so that an outlet of the supply pipe 47c opens in the casing. A cleaning roller 412c is rotatably arranged in the cleaning unit casing 411c under the outlet opening of the developer supply pipe 47c. The cleaning roller 412c comprises a sponge roller which comes in pressing contact with the photoconductor drum surface so as to remove the developer remaining thereon at the cleaning portion where the cleaning roller comes in contact with the photoconductor drum surface. The cleaning roller 412c is driven to rotate in such a way that the periphery surface thereof at the cleaning portion moves in the same direction as the photoconductor drum surface. Also, on the rear side (left side in the drawing) of the cleaning roller 412c, a cleaning liquid tray 413c for receiving and accumulating the liquid developer therein is installed in such a way that an end thereof is urged against the cleaning roller 412c. The cleaning liquid tray 413c is inclined upward in the direction away from the cleaning roller 412c. The outlet opening of the liquid developer supply pipe 47c is arranged above the cleaning liquid tray 413c. The cyanogen developer is supplied from the liquid developer supply pipe 47c into the tray 413c up to a predetermined level so that a periphery surface of a half side of the cleaning roller 412c is dipped therein. An over flow outlet (not shown) is provided at a predetermined level above the cleaning liquid tray 413c so as to maintain the amount of the liquid in the tray constant. The liquid in the tray is conveyed to the cleaning portion by the cleaning roller which comes in contact with the photoconductor drum surface so that the developer remaining on the photoconductor drum surface is removed by the cleaning function thereof. Besides, on the downstream side of the cleaning roller 412c with respect to the rotational direction of the photoconductor drum 26c (on the upper side of the cleaning roller in the drawing), a cleaning blade 414c is disposed in such a way that an end thereof abuts against the photoconductor drum surface so as to scrape and remove the developer which still remains after being rubbed by the cleaning roller 412c from the photoconductor drum surface.

Also, on the upstream side of the cleaning roller 412c with respect to the rotational direction of the photoconductor drum 26c (on the lower side of the cleaning roller in the drawing), i.e., at the inlet of the cleaning portion, a sealing plate 416c made from a flexible member is disposed in such a way that an end thereof abuts against the photoconductor drum surface. This sealing plate 416c comprises a polyester thin film or a polyurethane rubber. The width of the sealing plate 416c is slightly longer than that of the cleaning roller 412c so as to cover the entire width of the cleaning roller. The sealing plate 416c comprises a main portion 417c which spans the entire width of the cleaning roller 412c and auxiliary portions 418c which are formed at the both ends of the main portion 417c (only one auxiliary portion 418c is illustrated in FIG. 6). The main portion 417c abuts against the photoconductor drum surface in the area where the cleaning roller 412c is disposed. Whereas the auxiliary portion 418c abut against the photoconductor drum surface in the area outer the cleaning roller. The auxiliary portion 418c is slightly higher than the main portion 417c so that the auxiliary portion 418c is forced to abut against the photoconductor drum surface more strongly than the main portion is. Also, each of the auxiliary portions 418c has an inlined edge which inclines downward toward the inner side of the sealing plate 416c so that the liquid developer is guided to the main portion 417c along the inclined edge. The sealing plate 416c is secured to and supported by a front edge 420c of the casing 411c through spacers 212c so that a gap is formed between the sealing plate 416c and the front edge 420c of the casing. The inner edge of the sealing plate 416c is superposed on the front edge 420 of the casing 411c so as to form a double seal structure. The sealing plate 416c is attached to the casing 411c in such a manner that the sealing plate 416c is inclined downward toward the inner edge thereof from the outer edge which comes in contact with the photoconductor drum 26c. The sealing plate 416c is screwed on the spacers 421c in such a way that the lower inner edge thereof is projected further downward and inward into the bottom of the casing 411c from the spacers 421c. With such an arrangement, the sealing plate 416c functions in such a manner that, on the one hand, it allows the remaining developer on the photoconductor drum surface to pass therethrough to the cleaning roller side, and on the other hand, it interrupts the liquid developer which drops from the cleaning roller 412c and guides the developer into the bottom of the casing 411c. Also, the front edge 420c of the casing 411c is inclined in parallel with the sealing plate 416c.

In accordance with the above mentioned sealing plate 416c, it becomes possible that the remaining liquid developer sticked on the photoconductor drum surface passes through the sealing plate to the cleaning roller and that the liquid developer which drops from the cleaning roller 412c is received by the sealing plate. The liquid developer received by the sealing plate is guided to flow along the inclined sealing plate to the bottom of the casing 411c. Also, the liquid developer which sticks on the rear surface of the sealing plate 416c is similarly guided to flow along the inclined sealing plate to the bottom of the casing.

The bottom of the casing 411c constitutes a reservoir for accumulating the liquid developer within the casing. A screw conveyor 422c for discharging the liquid developer out of the reservoir is disposed in the reservoir along the photoconductor drum and in parallel with the longitudinal axis thereof. The return pipe 48c mentioned before is connected to an outlet of the screw conveyor 422c so that the liquid developer conveyed by the screw conveyor 422c is discharged from the reservoir through the return pipe 48c.

Note that the other cleaning units 41bk, 41m and 41y of a different color have the same structure as the above mentioned cleaning unit 41c. Therefore, they are not further referred to in this specification.

Note also that the present invention can be applied to any kind of the wet type image forming apparatus other than the full color image forming apparatus, such as a monochromatic wet type image forming apparatus and a twin color wet type image forming apparatus.

Figure 7:
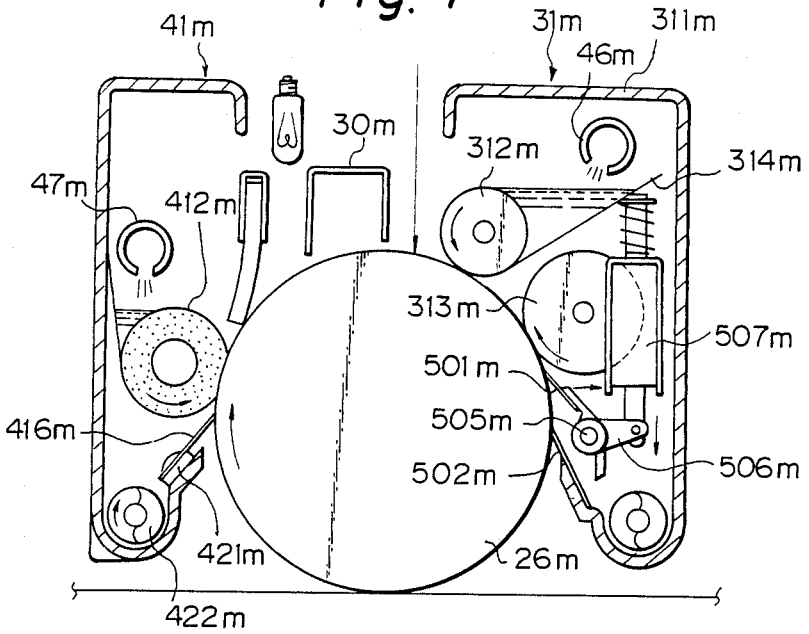
FIG. 7 is a constructional view of a cleaning device and a development device in accordance with another embodiment of the present invention.
Figure 8:
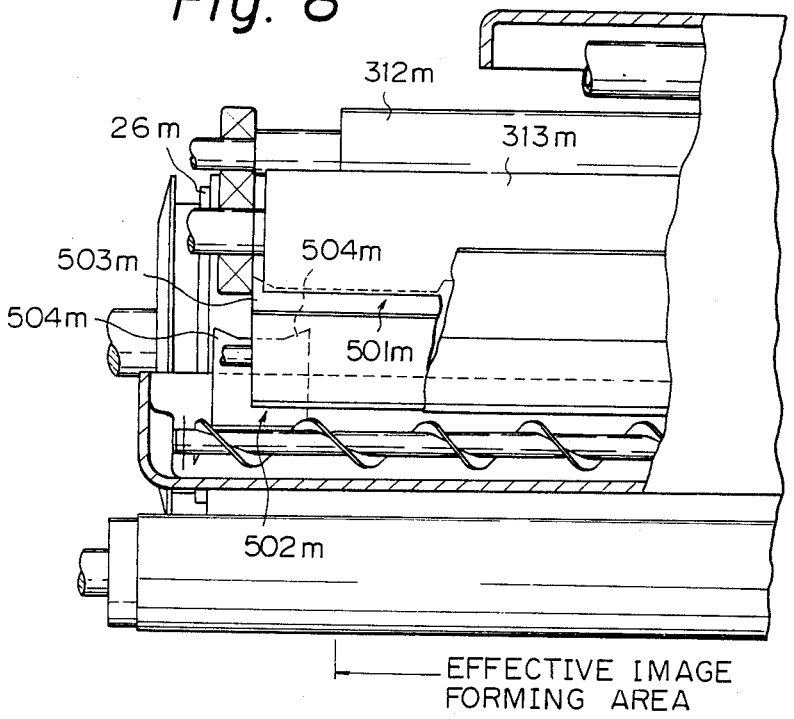
FIG. 8 is a partial sectional view of the development device of FIG. 7.

FIGS. 7 and 8 illustrate another example of the magenta development unit in accordance with the present invention. In the drawings, the same or corresponding parts are designated by the same reference number as the first embodiment mentioned above. In this embodiment, two steps of the liquid drip prevention plate are arranged in the downstream side of the squeeze roller 313*m* with respect to the ratational direction of the photoconductor drum, i.e., in the lower side of the development portion. A first drip prevention plate 501*m* is slightly longer than the entire length (width) of the squeeze roller 313*m* which is longer than the effective image forming area on the photoconductor drum 26*m*. A second drip prevention plate 502*m* is disposed in the downstream side (lower side) of the first drip prevention plate 501*m* in such a way that a part of the first drip prevention plate 501*m* is superposed on the second drip prevention plate 502*m*. More particularly, the second drip prevention plate 502*m* has a length that substantially covers from the end of the effective image forming area to each end of the photoconductor drum 26*m* and it is arranged in such a way that the second drip prevention plate abuts against the nonimage forming area on the outside of the effective image forming area. Each end portion 503*m* of the upper edge of the first drip prevention plate 501*m* has an inclined edge which inclines downward toward the center of the plate so that the liquid developer is guided toward the inner (center) side of the drip prevention plate. Also, the second drip prevention plate 502*m* comprises an ear piece 504*m* formed on the upper edge at each end thereof. Each ear piece 504*m* has an inclined upper edge which inclines downward toward the center of this second drip prevention plate 502*m* so that the liquid developer is guided toward the inner (cènter) side of the second drip prevention plate along the inclined edge.

A lower edge of the first drip prevention plate 501*m* is secured to a support shaft 505*m*. A swing arm 506*m* is attached to the support shaft 505*m*. Also, a drive shaft of a drive plunger 507*m* is connected to the swing arm 506*m*. When the drive plunger 507*m* is supplied with an electric current, the first drip prevention plate 501*m* is rotated to move away from the photoconductor drum 26*m*. On the other hand, when the electric current is cut off, the first drip prevention plate 501*m* is rotated to move back to the position where the plate comes in contact with the photoconductor drum 26*m*. The second drip prevention plate 502*m* is immovably secured to an edge of the development unit casing 311*m*. This is because that it is not necessary to move the second drip prevention plate away from the photoconductor drum surface since the second drip prevention plate is disposed in the nonimage forming area so that the plate does not scrape the developed visual image formed on the photoconductor drum surface.

With such a structure of the first and second drip prevention plates 501*m* and 502*m* arranged in two steps along and in contact with the photoconductor drum surface, when the operation of the development unit is stopped, the first drip prevention plate 501*m* interrupts the liquid developer which flows down from the development portion through the squeeze roller 311*m*, firstly. Then, if the liquid developer overflows from the first drip prevention plate 501*m* through the both side ends thereof, the orerflowed developer is interrupted by the second drip prevention plate 502*m* which extends from the end of the first drip prevention plate to the end of the photoconductor drum 26*m*. Therefore, the liquid developer is reliably prevented from dripping from the photoconductor drum side onto the transferring portion.

Many widely different embodiments of the present invention may be constructed without departing from the spirit and scope of the present invention. It should be understood that the present invention is not limited to the specific embodiments described in the specification, except as defined in the appended claims.

What is claimed is:

1. A wet type image forming apparatus comprising:

a rotary photoconductor drum having a surface on which an electrostatic latent image is formed;

a development unit for forming a visual image from the latent image by supplying the photoconductor with a liquid developer;

a transferring portion under the photoconductor drum where the developed visual image is transferred to a transfer paper;

a cleaning unit for removing the liquid developer which remains on the surface of the photoconductor after the visual image is transferred to the transfer paper; and a drip prevention plate which is arranged to come in contact with the photoconductor surface to prevent the liquid developer from dripping through the photoconductor surface.

2. A wet type image forming apparatus according to claim 1, wherein the drip prevention plate is disposed in the development unit in such a way that an upper edge thereof abuts against the photoconductor surface.

3. A wet type image forming apparatus according to claim 1, wherein the drip prevention plate is disposed in the cleaning unit in such a way that an upper edge thereof abuts against the photoconductor surface.

4. A wet type image forming apparatus according to claim 1, wherein the drip prevention plate is inclined downward toward the direction away from the photoconductor.

5. A wet type color image forming apparatus comprising:

a plurality of photoconductors disposed on a line in series on each of which photoconductors an electrostatic latent image of a different color is formed;

a plurality of liquid developer tanks from which a liquie developer of a different color is supplied to the corresponding photoconductors, respectively, to form a visual image thereon;

a transferring portion disposed under each of the photoconductors where the visual image is transferred to a transfer paper in such a way that the visual images of a different color formed on the photoconductors are superposed one above the other in sequence to form a multicolored image on the transfer paper;

a conveyor belt which passes through each transferring portion to interconnect the transferring portions disposed under the plurality of the photoconductors, respectively;

a plurality of cleaning units disposed corresponding to the plurality of the photoconductors, respectively, for removing the liquid developer remaining on the photoconductor after the visual image is transferred to the transfer paper; and a sealing plate disposed for each of the cleaning units in such a way that the sealing plate abuts against the photoconductor surface on an upstream side of a cleaning portion with respect to a direction of the movement of the photoconductor surface so as to prevent the liquid developer from dripping.

6. A wet type color image forming apparatus according to claim 5, wherein the sealing plate is secured to a support member through a spacer in such a way that a gap is formed between the sealing member and the support member so as to form a double seal structure.

7. A wet type color image forming apparatus according to claim 6, wherein the support member to which the sealing plate is secured is a front edge of a casing of the cleaning unit wherein the sealing plate is arranged in such a way that a fixing side edge of the sealing plate is projected inward into the casing over the front edge thereof and that the sealing plate is inclined so that the fixing side edge thereof becomes a lower edge thereof directed to a reservoir formed in the casing.

8. A wet type color image forming apparatus comprising:

a plurality of photoconductors disposed on a line in series on each of which photoconductors an electrostatic latent image of a different color is formed;

a plurality of liquid developer tanks from each of which tanks a liquid developer of a different color is supplied through a development unit to a corresponding photoconductor to form a visual image thereon;

a transferring portion disposed under each of the photoconductors;

a conveyor belt which passes through each transferring portion to interconnect the transferring portions disposed under the plurality of the photoconductors, respectively; and a liquid drip prevention plate disposed for each of the development units in such a way that the liquid drip prevention plate abuts against the photoconductor surface on an upstream side of a development portion with respect to a direction of the movement of the photoconductor surface so as to prevent the liquid developer from dripping.

9. A wet type color image forming apparatus according to claim 8, wherein the liquid drip prevention plate is linked with a drive control means which drives the drip prevention plate in such a way that during the time that the developed visual image passes the portion where the drip prevention plate is mounted, this drip prevention plate is moved away from the photoconductor to be discontacted therefrom.

10. A wet type color image forming apparatus according to claim 8, wherein the liquid drip prevention plate means comprises a first drip prevention plate which covers an entire width of an effective image forming area on the photoconductor surface and a second drip prevention plate which is disposed in a downstream side of the first drip prevention plate with respect to the direction of the movement of the photoconductor and which extends from an end portion of the first drip prevention plate to an end portion of the photoconductor.

* * * * *